United States Patent [19]

Calutoiu

[11] Patent Number: 4,507,805

[45] Date of Patent: Apr. 2, 1985

[54] AMBULATORY SLEEPING BAG

[76] Inventor: Nicolae I. Calutoiu, 1923 N. Carmen Ave., Los Angeles, Calif. 90068

[21] Appl. No.: 562,034

[22] Filed: Dec. 15, 1983

Related U.S. Application Data

[63] Continuation-in-part of Ser. No. 521,593, Aug. 9, 1983, abandoned.

[51] Int. Cl.[3] ..... A41D 15/04

[52] U.S. Cl. ..... 2/69.5; 2/86; 2/94; 5/413

[58] Field of Search ..... 2/69.5, 81, 82, 84, 2/85, 87, 86, 94; 5/413, 95, 102

[56] References Cited

U.S. PATENT DOCUMENTS

| | | | |
|---|---|---|---|
| 2,469,700 | 3/1947 | Petrucelli | 2/69.5 |
| 2,497,167 | 5/1947 | Guyol | 2/69.5 |
| 2,598,462 | 5/1952 | Strauss | 2/69.5 |
| 2,611,131 | 9/1952 | Heeter | 2/69.5 |
| 2,744,253 | 5/1956 | Freedman | 2/69.5 |
| 2,915,758 | 3/1958 | Kaufman | 2/69.5 |
| 2,967,306 | 1/1961 | Fabanich | 2/87 |
| 3,837,006 | 9/1974 | Laseman | 2/69.5 |
| 3,924,273 | 12/1975 | Donovan | 5/413 |
| 4,103,377 | 8/1978 | Mayer et al. | 2/69.5 |
| 4,122,553 | 10/1978 | Pitkanen | 2/102 |
| 4,125,910 | 11/1978 | Nicholai | 2/69.5 |
| 4,158,892 | 6/1979 | Gonzales | 2/69.5 |
| 4,302,850 | 12/1981 | Maeshima | 2/102 |

*Primary Examiner*—Werner H. Schroeder
*Assistant Examiner*—Mary A. Ellis
*Attorney, Agent, or Firm*—Jerry W. Berkstresser; Bruce G. Klaas

[57] ABSTRACT

A convertible sleeping bag for use as a sleeping bag and an ambulatory garment having integral upper torso and lower torso portions, the upper torso portion having a front and back and at least two closeable openings, each having two sides when open and extending generally vertically of the bag and provided with closure elements on each side of the opening which can selectively open each vertical opening and engage another vertical opening closure element so as to be capable of closing each vertical opening to form at least one separate closed arm shaped portion in the upper torso portion; and the lower torso portion having at least two closeable openings, each having two sides when open and extending vertically of the bag and provided with closure elements on each side of the opening which can selectively open each vertical opening and engage the other open vertical opening closure element to close each vertical opening in a manner to leave an opening from the front to the back of the sleeping bag while forming two closed generally leg shaped portions in the lower torso portion of the sleeping bag; and at least two separate closeable openings each at the lower extremities of the leg shaped portions for receiving each of the feet of the user of the sleeping bag.

5 Claims, 10 Drawing Figures

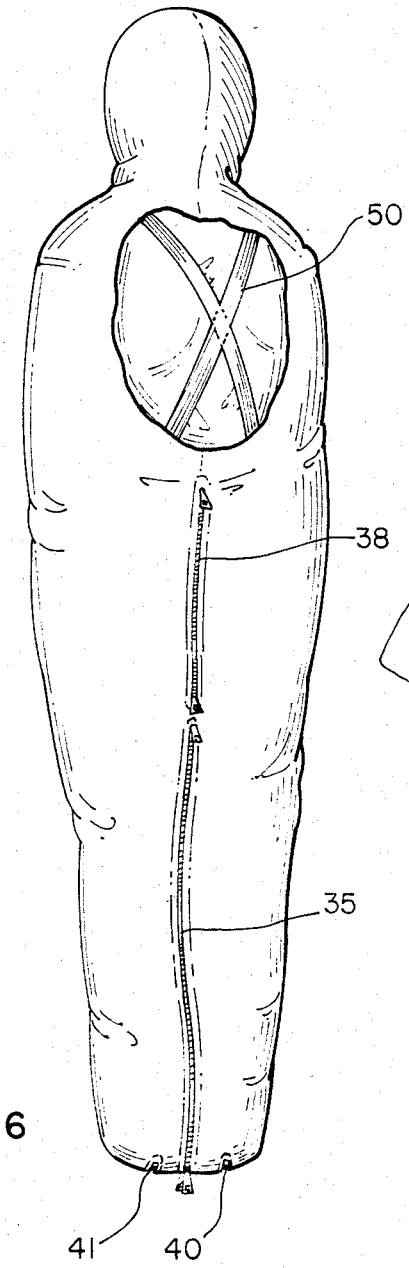
FIG. 6
FIG. 7
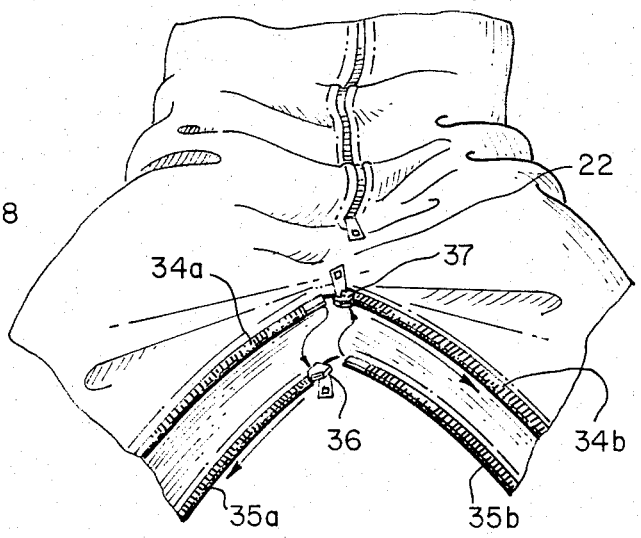
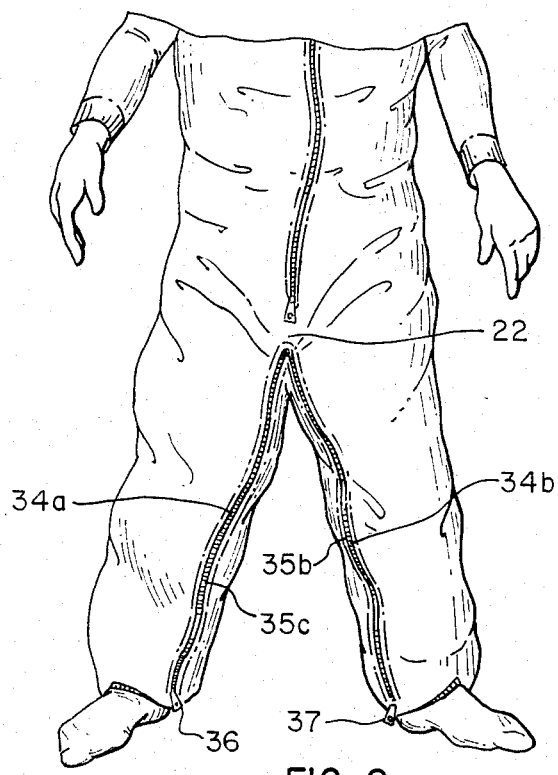
FIG. 8

AMBULATORY SLEEPING BAG

This application is a continuation-in-part of application Ser. No. 521,593, filed 8/9/83, now abandoned.

This invention relates to sleeping bags primarily for outdoor camping use, and in particular to a sleeping bag that is easily converted to a form which permits its user to walk about freely without having to get out of the bag.

BACKGROUND OF THE INVENTION

Sleeping bags for camping use which can be converted to a temporary garment have been constructed in various ways in the past. The U.S. Patents to Nicholai, U.S. Pat. No. 4,125,910 issued Nov. 21, 1978, and Mayer et al, U.S. Pat. No. 4,103,377 issued Aug. 1, 1978; are exemplary of these prior attempts at providing a simple, convenient convertible sleeping bag.

The problems confronting a designer in this field are the same as described in these referenced patents. That is, to provide a sleeping bag structure that is adequate to protect the user while maintaining the comfort and convenience of typical modern sleeping bag materials and designs, while making it possible for the user to become ambulatory, in the bag. This latter design requirement is important in outdoor camping situations if the user desires the warmth provided by the sleeping bag while attending to both personal and camping needs.

It is therefore an objective of the present invention to provide a conventional sleeping bag structure which is easily converted to ambulatory use without the requirement that the user abandon the warmth and comfort of the sleeping bag while attending to personal and camping necessities.

It is a further objective of the present invention to provide a convertible sleeping bag structure for accomplishing the foregoing objective which is relatively uncomplicated and easy to use.

It is a yet further objective of the present invention to provide a convertible sleeping bag structure which is both easy for the user to convert as well as inexpensive in the cost of making the structural modifications which impart the aforementioned utility.

BRIEF DESCRIPTION OF THE DRAWINGS

FIG. 6 is a partially broken rear view of the sleeping bag of FIG. 5 shown with the internally disposed suspender structure exposed.

FIG. 7 is a partial front view of both of the open fasteners shown in FIG. 5.

FIG. 8 is a partial front view of the fasteners of FIG. 7 refastened according to the arrows in that figure.

DETAILED DESCRIPTION OF THE DRAWINGS

Figure 1:
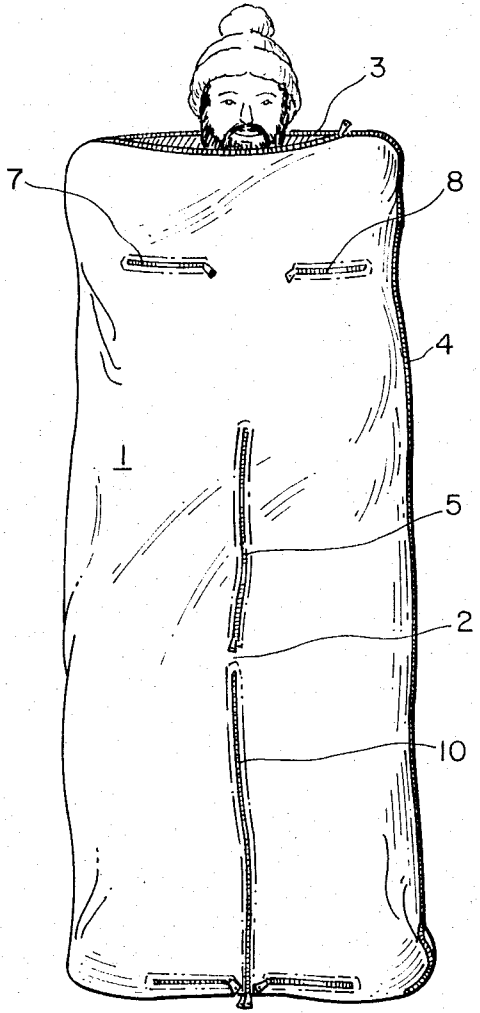
FIG. 1 is a front view of a sleeping bag according to the present invention shown in its closed condition.

Utilizing the concepts of the present invention it is possible to modify or construct either a conventional rectangular sleeping bag or a so-called mummy-type sleeping bag for comfortable ambulatory use under a wide variety of circumstances. Contrasted with the prior art efforts in this regard, the sleeping bag of the present invention can be provided with a minimum of structural modifications to existing available sleeping bags. For purposes of illustration, FIG. 1 shows a typical rectangular style sleeping bag 1, modified according to the present invention. The sleeping bag of FIG. 1 can be viewed as comprising an upper torso portion extending downward to the general location of the crotch 2. The upper torso, thus defined, includes the conventional outside zippers or fasteners 3 and 4 as well as a convenience zipper 5. In addition to the foregoing, horizontal zippers 7 and 8 are provided with fasteners which can either be actuated from the inside of the sleeping bag (as illustrated) and/or from the inside of the sleeping bag to provide openings, through which the arms of the user can be extended to the outside of the bag for manipulative freedom. As in a conventional sleeping bag, the head of the user can be extended through the opening provided by the opening provided by closure member 3, while ingress and egress from the bag is possible through either that member or closure member 4.

The lower torso portion of the sleeping bag of the present invention is characterized from prior structures in that vertical closure members are provided centrally on the front and back of the rectangular shaped sleeping bag structure.

An important distinction between the prior structures and the structure of the present invention is the fact that the vertically disposed front closure element 10 and the rear closure element 11 are constructed so that while each opens the front and back vertically, as shown, they can each be fastened to the opened closure element on each side to close, from front to back the vertical openings created by their being originally opened, as shown at 12 and 13. In this manner a pair of leg receiving portions are created without the need for providing supplementary structure.

In addition, the individual leg receiving portions are provided at their respective lower extremities with individual closure elements shown at 20 and 21 so that the user may open each element and then extend his feet through the respective openings so as to move about freely.

Figure 3:
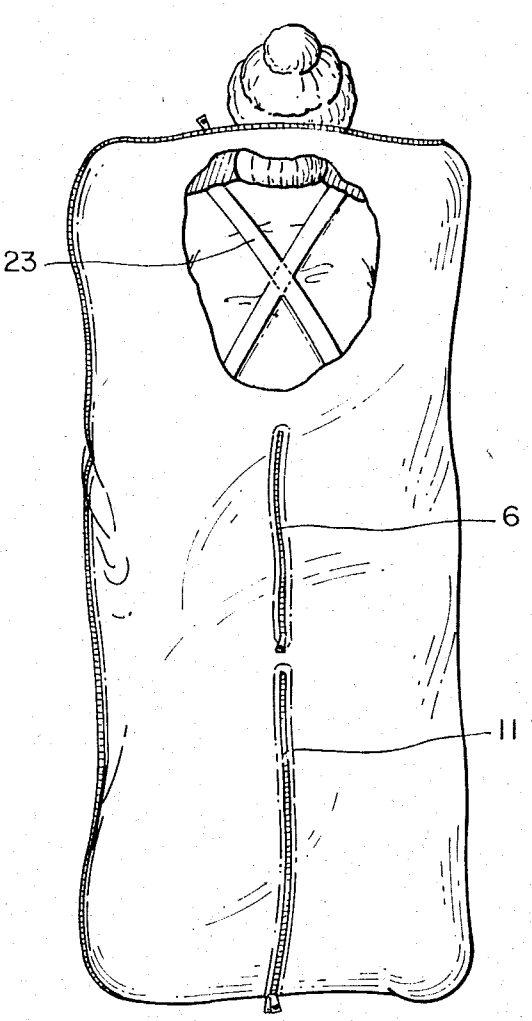
FIG. 3 is a partially broken rear view of a sleeping bag according to the present invention with further suspender structure shown.
Figure 2:
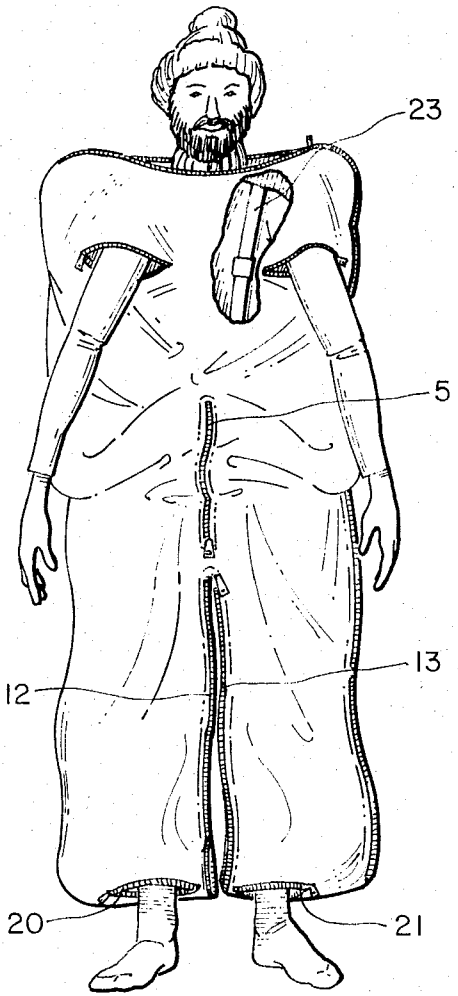
FIG. 2 is a partially broken front view of a sleeping bag according to the present invention with the user's arms and feet exposed and showing the internal suspender construction.

Finally, the interior of the sleeping bag of the present invention is provided with adjustable suspenders 20 as shown in FIGS. 2 and 3 which are attached to the interior of the sleeping bag at the bottom of the upper torso portion of the bag so that the user of the bag can maintain the bag at the proper comfortable location when the user's feet are extended through the openings 20 and 21, as shown in FIG. 2. In this manner, the user, by adjusting the length of the suspenders 23, can make the bag comfortable for sleeping, FIG. 3, or for walking, FIG. 2.

The mummy-type bag shown in FIGS. 4, 5, 6, 7, and 8 can also be constructed to take advantage of the present invention.

Figure 4:
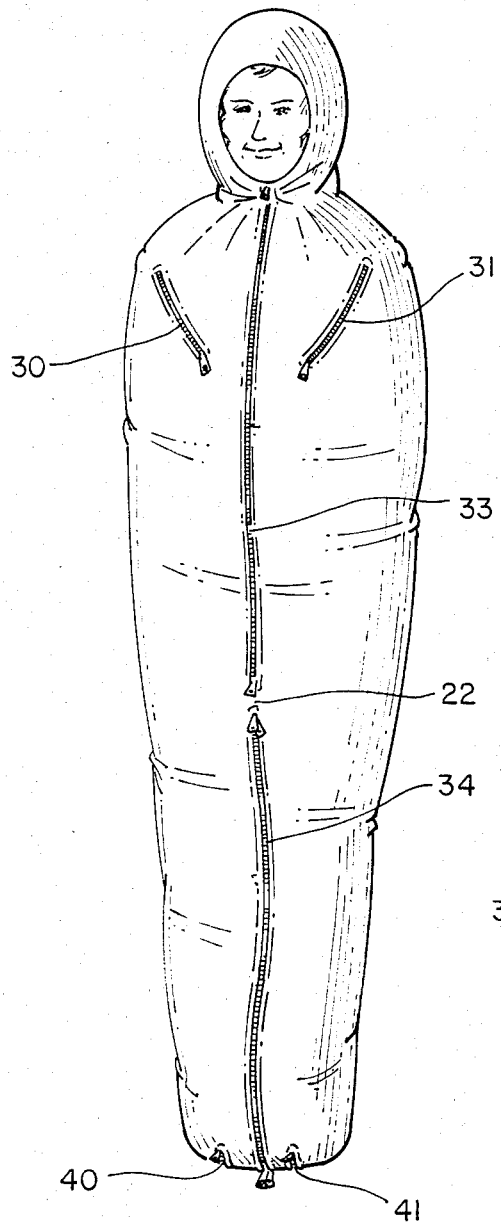
FIG. 4 is a front view of another sleeping bag according to the present invention shown in its closed condition.

In FIG. 4, diagonal closure elements 30 and 31, are provided on this style of sleeping bag for ease of use by the user for extending his or her arms out of the bag. Again, these arm openings should be openable from the inside and may also be openable from the outside, if desired. As in conventional mummy-type sleeping bags, the front zipper can be a single zipper running vertically the entire length of the bag (not shown) or the closure element may be segmented if desired, using two zippers or closure elements 33 and 34 as shown. It may optionally be desireable for all zippers to be of the double action or acting type. That is, with two slides which are each capable of opening and closing the closure element. In other embodiments, not shown, it is also contemplated that fasteners other than zippers may be employed. For example, the cloth hook and loop-type materials known by the trademark VELCRO may be employed effectively as well as other fasteners including buttons and snaps.

Figure 5:
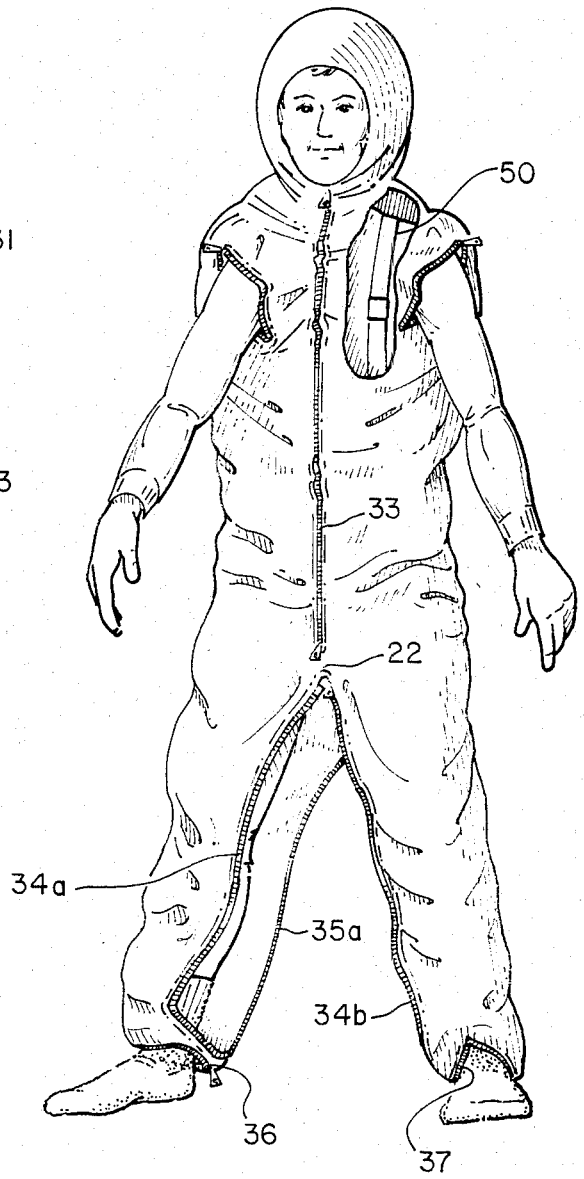
FIG. 5 is a partially broken front view of the sleeping bag of FIG. 4 shown in an open condition with the user's arms and feet extending therefrom and with the insides of the user's legs exposed.

Again, as shown in FIGS. 5 and 7, the lower torso portion of the sleeping bag is constructed in such a manner so that opening the zippers 34 and 35 (FIG. 6), will expose the legs of the user (FIG. 5) until one track of the front zipper 34*a* is connected with one track of the rear zipper 35*a* by means of slide 36. Then, when one track of the rear zipper 35 (35*b*) is connected by slide 37 to the rear track 35*b* of zipper 35, and both zippers are closed, as shown in FIG. 8, the ambulatory structure shown in FIG. 8 can be formed. To complete the utility of the bag structure, the zippers 40 and 41 can be opened, preferably from the outside to form openings for the feet of the user, as shown in FIG. 8.

Most of the closure elements shown can be double acting zippers, as shown more clearly at 38 in FIG. 6. It is a matter of individual choice whether to make any of the zippers double acting. As previously described, an individual slide element may also be selected so as to be actuateable from either or both sides of the sewn-in zipper structure. In the partially broken away views of FIGS. 5 and 6, the mummy-style sleeping bag is also provided with adjustable suspenders 50, if desired.

In addition to the foregoing description, the convenience zippers or closure members 5, 6, 33 and 38 can be continuous with the fasteners used for forming the leg receiving areas of the sleeping bag or segmented and separate as shown.

Likewise, the shape and location of the closure elements for the arm holes and the attachment points and degree of adjustment provided by the suspenders can be preselected, if desired, to provide for different sized persons. In this manner, the sleeping bag of the present invention can be constructed in a wide range of sizes to accommodate the physique of the user.

Figure 9:
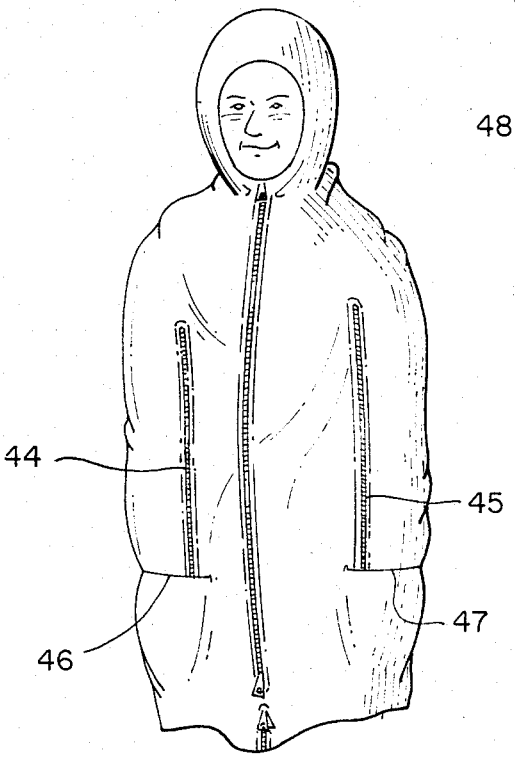
FIG. 9 is a partial front view of another embodiment of the present invention.
Figure 10:
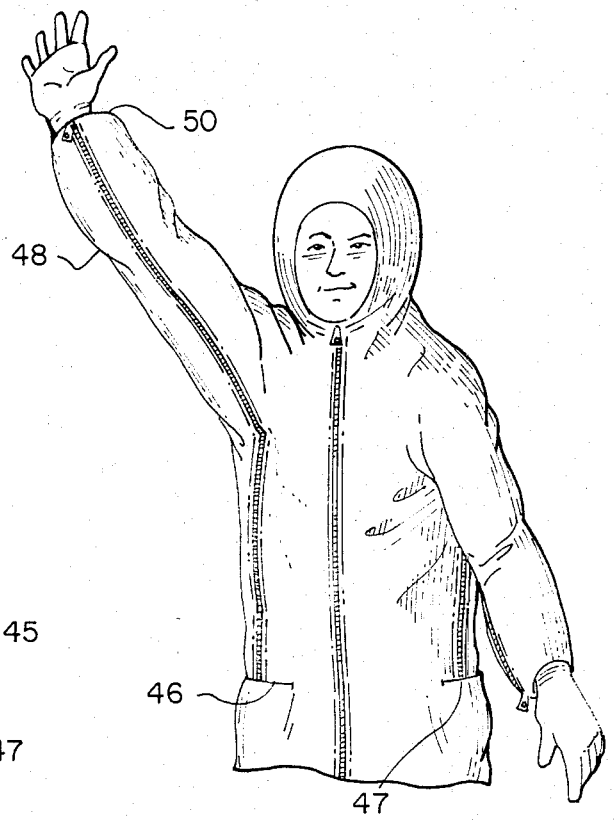
FIG. 10 is a partial front view of the embodiment of FIG. 9 with the user's arms free to move.

For example, yet another embodiment is shown in FIGS. 9 and 10, with slide fasteners 44 and 45 of the type described previously. In addition to the slide fasteners 44 and 45, exterior pockets 46 and 47 can be provided with elastic or other closure means. The pockets 46 and 47 are shown open in FIG. 9 and closed in FIG. 10. Preferably, the pockets 46 and 47 are not provided with bottoms so that the user can use the sleeping bag in the normal manner. If desired, the closure means employed for the pocket lip can also be arranged to fasten to the sleeve portion of the sleeping bag to prevent inadvertent draft openings at the juncture of the sleeve portion of the bag and the pocket opening.

Utilizing the same type of fastener configuration shown in FIGS. 7 and 8, the sleeve portion 48 can be closed in the same manner as the leg portions and provide a garment-like arm receiving portion as shown in FIG. 10. The specific construction of the cuff portion can vary as well as the specific construction of the opening for the pockets 46 and 47, still utilizing the specific sleeve forming fastener structure described. Likewise, the invention is not limited to the specific mummy-type of bag configuration shown and can be used alone as shown or in combination with the arm holes or arm hole closures previously described. The fastener configuration for the general opening of the bag for easy entry can also vary while still utilizing the arm or sleeve-forming structure described.

It is further contemplated that nearly any currently used sleeping bag structural materials can be used effectively with the present invention. Outer shell materials, lining materials and filling materials that are presently employed can be used with this invention, as well as with sleeping bags which are only a single or double thickness of material. The provision of the closure elements, as described, can be accomplished with a minimal effect on the insulating properties desired in sleeping bags used for outdoor recreation use. Specific alterations to provide the bag with the structure of the present invention can be accomplished by conventional methods and require no further explanation here.

It is contemplated that the inventive concepts herein described may be variously otherwise embodied and it is intended that the appended claims be construed to include alternative embodiments of the invention except insofar as limited by the prior art.

What is claimed is:

1. A convertible sleeping bag for use as a sleeping bag and an ambulatory garment having integral upper torso and lower torso portions, said upper torso portion having a front and back and at least two closeable openings, each having two sides when open and extending generally vertically of the bag and provided with closure elements on each side of said opening which can selectively open each vertical opening and engage another vertical opening closure element so as to be capable of closing each vertical opening to form at least one separate closed arm shaped portion in said upper torso portion;

said lower torso portion having at least two closeable openings, each having two sides when open and extending vertically of the bag and provided with closure elements on each side of said opening which can selectively open each vertical opening and engage the other open vertical opening closure element to close each vertical opening in a manner to leave an opening from said front to said back of said sleeping bag while forming two closed generally leg shaped portions in said lower torso portion of said sleeping bag; and at least two separate closeable openings each at the lower extremities of said leg shaped portions for receiving each of the feet of the user of the sleeping bag.

2. The sleeping bag of claim 1 wherein the closeable openings at the lower extremities of the bag each extend generally from the front to the back of the bag.

3. The sleeping bag of claim 1 wherein the closeable openings of the lower extremities of the bag each extend generally horizontally in the direction from side to side of the bag.

4. The sleeping bag of claim 1 wherein adjustable suspenders are provided internally of the bag and attached thereto.

5. The sleeping bag of claim 1 wherein said upper torso portion of said bag also contains additional closure elements located at the lower most extremity of each of said closeable openings defining pocket openings for said arm shaped portions when said closeable openings are either open or closed.

* * * * *